US008025248B1

(12) United States Patent
Nebel et al.

(10) Patent No.: US 8,025,248 B1
(45) Date of Patent: Sep. 27, 2011

(54) TURBINE FOR MATERIAL COMMINUTOR

(76) Inventors: David J. Nebel, Zwingle, IA (US); Ernest R. Schmidt, Saratoga, CA (US)

( * ) Notice: Subject to any disclaimer, the term of this patent is extended or adjusted under 35 U.S.C. 154(b) by 215 days.

(21) Appl. No.: 12/350,041

(22) Filed: Jan. 7, 2009

Related U.S. Application Data

(60) Provisional application No. 61/019,369, filed on Jan. 7, 2008.

(51) Int. Cl.
*B02C 19/00* (2006.01)

(52) U.S. Cl. ..... 241/301; 241/1; 415/121.1

(58) Field of Classification Search ..... 241/1, 301; 415/121.1, 204
See application file for complete search history.

(56) References Cited

U.S. PATENT DOCUMENTS 4,718,609 A 1/1988 Rolle et al.
4,852,818 A 8/1989 Rolle et al.
4,892,261 A 1/1990 Rolle et al.

*Primary Examiner* — Mark Rosenbaum
(74) *Attorney, Agent, or Firm* — John P. Costello; Costello Law Corp.

(57) ABSTRACT

The invention is a detachable "blade foil" system for comminuting machines which employ a rotating turbine. The turbine blades are each endowed with a detachable leading edge which is shaped in an air foil configuration. These "blade foils" are penetrated by a vent chamber having an inlet port and an outlet port. The vent chambers aid in drying input material that is processed by a comminuting machine and also aid in reducing sound from the turbine. The configuration of the inventive blade foils also vary to aid in material drying. The configuration of the blade foils also define the level of particle size attributed to the processed output material. Hence by selecting particular blade foil configurations the operator can achieve different levels of material drying and differing output particle sizings.

20 Claims, 5 Drawing Sheets

TURBINE FOR MATERIAL COMMINUTOR

CROSS REFERENCE TO RELATED APPLICATIONS

This patent application claims the benefit of U.S. provisional patent application Ser. No. 61/019,369, filed on Jan. 7, 2008.

TECHNICAL FIELD

This invention relates to comminuting devices for reducing the particle size of materials, and more particularly to comminuting devices which employ a rotating turbine mounted in a housing for causing an air flow through an expansion chamber.

BACKGROUND

Comminuting devices which use a high speed rotating turbine to reduce the size of and to separate particulate materials have been in existence for quite some time. Devices of this type are found in the patents attributed to Rolle, et al. (U.S. Pat. Nos. 4,852,818; 4,718,609; and 4,892,261). The turbine component of the device is made of a plurality of air foil blades mounted on a backing plate and is dimensioned in close tolerances to a housing. Mounted in front of the turbine blade and its housing is an expansion chamber of frustoconical shape.

In these devices, material to be comminuted is carried in an air stream through an acceleration tube and into the expansion chamber, where it is rapidly decompressed, causing it to explode. The spinning turbine produces a negative pressure in the expansion chamber and introducing raw materials at a specific rate into the chamber allows air trapped in the material to expand in the negative pressure environment, thereby causing the explosion of the material into smaller particles. The smaller particles can then be size-separated by methods well known in the art, such as by a specific gravity separator.

It is known in the art of comminuting devices that adjusting the negative pressure achieved by the device results in variations in particle size dimensions. Known methods for varying the negative pressure include varying the RPM of the turbine and varying the length of the expansion chamber. However, the art has not addressed varying the design of the turbine blades or the leading edges of the turbine blades to help achieve further fine tuning of the negative pressure variants achievable in comminuting devices.

The foregoing reflects the state of the art of which the inventor is aware, and is tendered with a view toward discharging the inventor's acknowledged duty of candor, which may be pertinent to the patentability of the present invention. It is respectfully stipulated, however, that the foregoing discussion does not teach or render obvious, singly or when considered in combination, the inventor's claimed invention.

SUMMARY OF THE INVENTION

The invention is an improved turbine design for a comminuting device; the improvements include variations to the leading edge portion of the turbine blade. In the instant invention, the leading edges are removably attached to the turbine blades and comprise air foils. For purposes of this description, the leading edges will be termed "blade foils" herein. The blade foils have a vent chamber penetrating there through, each vent chamber having an inlet port and an outlet port where the inlet is typically narrower than the outlet port. The blade foils increase the volume of air through which the comminuted material must pass, thus resulting in faster and more complete drying of the material than found in prior art comminuting machines. The shape of the blade foils vary in that differing foil configurations result in differing sizing of material particles at discharge, and also differing moisture contents present in the discharged material. Further adjustments to the angle of the blade foils, the size of the vent chamber, the shape of the vent chamber and the blade angles all contribute to differing performance in terms of air flow volume and moisture reduction in the material that is discharged from the comminuting device incorporating the noted improvements.

Accordingly, the following objects and advantages of the invention apply:

It is an object of this invention to provide a comminuting machine which allows for multiple turbine parameters to be set up to specifically achieve selected particle sizes of materials and selected moisture content of materials.

It is another object of this invention to provide a system of leading edge air foils (blade foils) which can be attached to a comminuting machine turbine to produce a higher or lower volume of air movement, selectable particle sizes in discharged materials and increased or decreased moisture reduction in discharged materials.

Further objects and advantages of the invention will be brought out in the following portions of the specification, wherein the detailed description is for the purpose of fully disclosing the preferred embodiments of the invention, without placing limitations thereon.

DETAILED DESCRIPTION OF THE PREFERRED EMBODIMENTS

Figure 1:
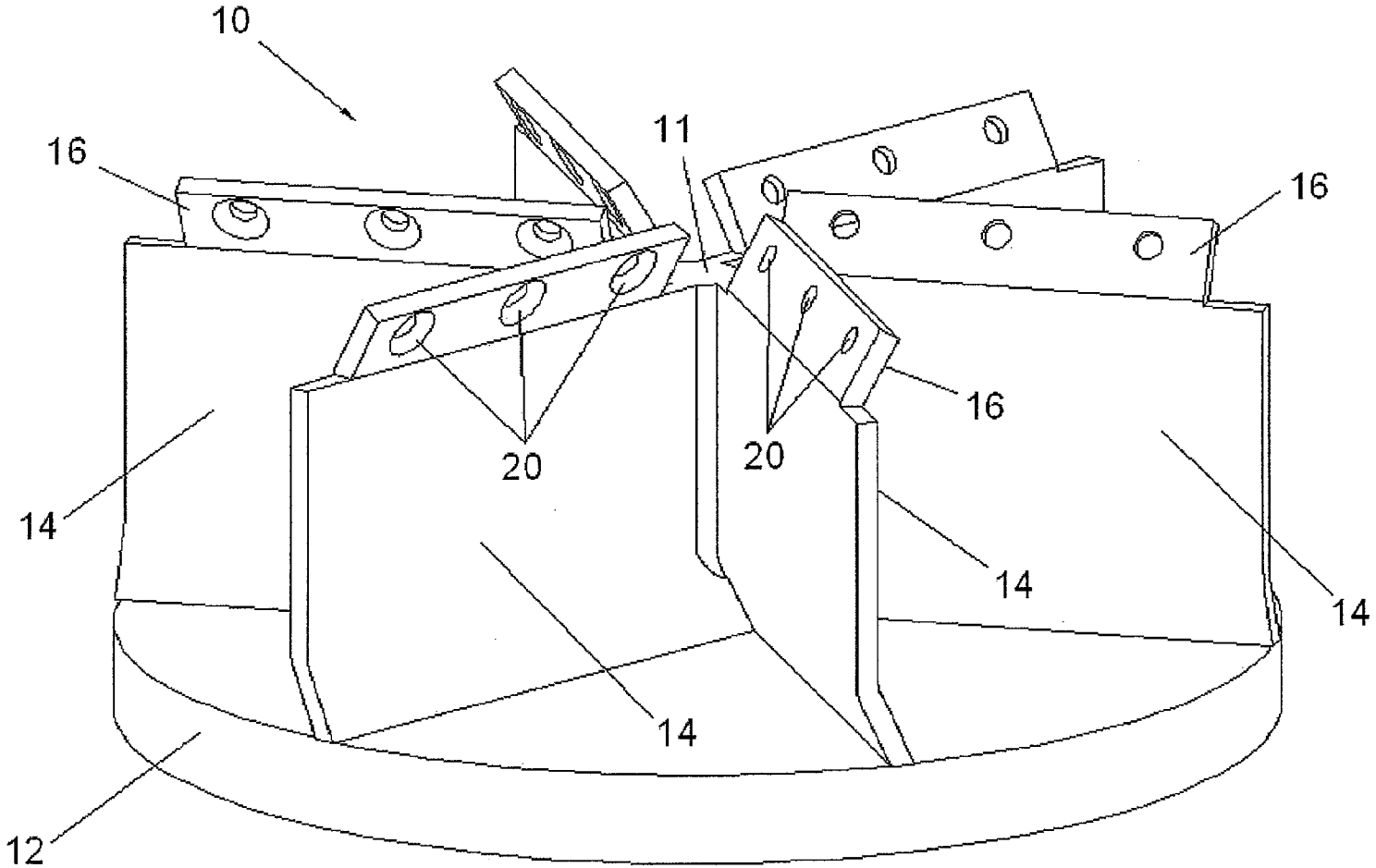
FIG. 1 is a perspective view of a turbine for a comminuting machine shown without blade foils attached.
Figure 2:
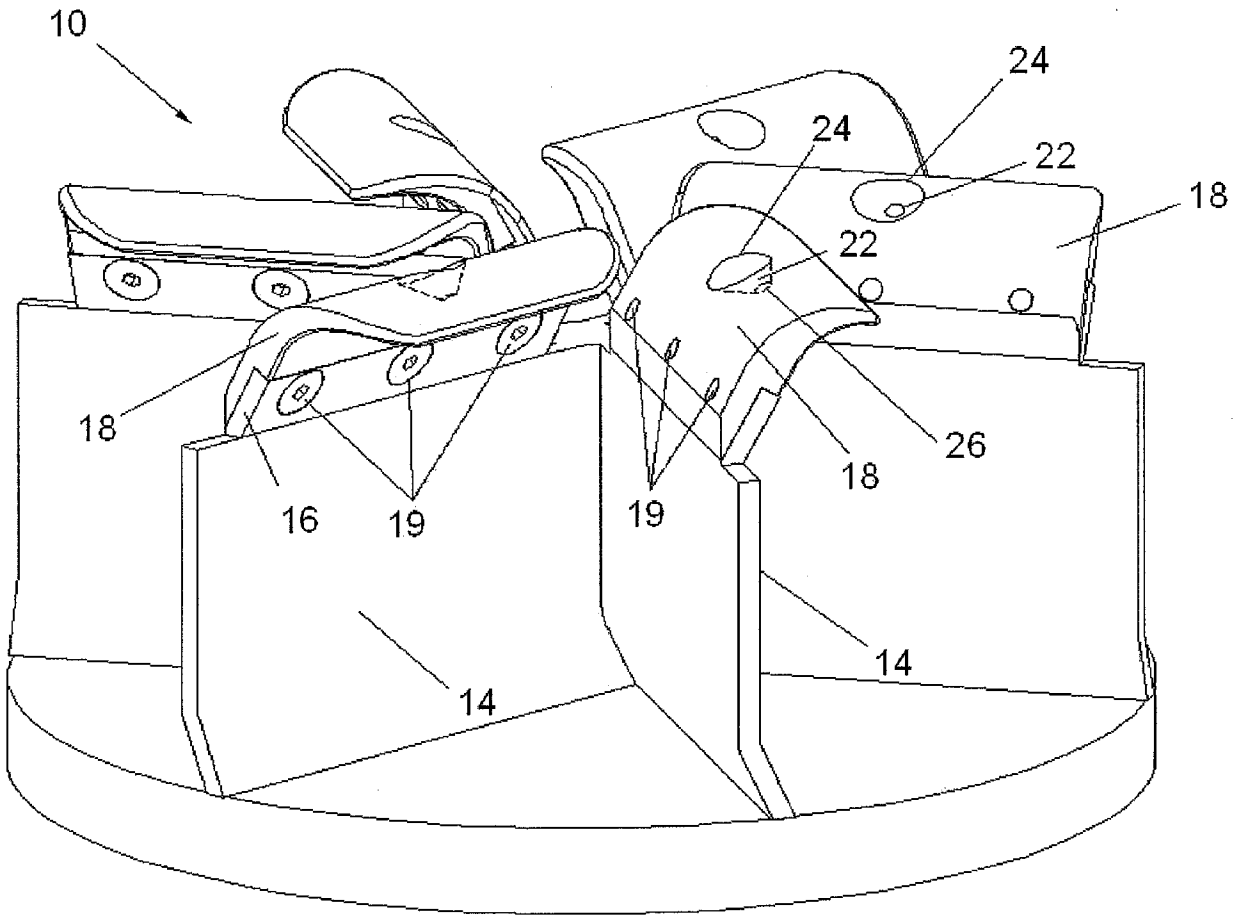
FIG. 2 is a perspective view of the turbine of FIG. 1, this view showing the blade foils attached to the turbine.

Referring generally to FIGS. 1 and 2, a turbine 10 for a comminuting machine in accordance with the invention is shown. This turbine 10 is comprised of a backing plate 12, where here, six turbine blades 14 are attached to the backing plate and extend upward from the backing plate. The blades 14 can be attached to the backing plate 12 by any suitable means, such as bolting or welding to the backing plate. The blades are joined together at a central axis 11. As shown in FIG. 2, attached to the leading edges 16 of the turbine blades 14 are corresponding detachable blade foils 18. Leading edges 16 are angled to give the blade foils the proper attitude when contacting an air flow. The blade foils 18 function to provide increased volumes of air movement through the machine and also to provide varying degrees of moisture content present in the discharged particulate materials. While blade foils 18 can be permanently attached to blades 14, the true utility of the invention is realized when the blade foils 18 are detachably joined to blades 14. The blade foils 18 can be attached to the leading edge 16 of the turbine blades 14 by bolting at through-holes 20, which are imparted in the leading edges 16, as shown here. Blade foils 18 have corresponding through-holes 21 which align with through holes 20 of turbine blades. Through-holes 21 in blade foils 18 can be threaded for introducing a correspondingly threaded hex head bolt fastener 19. Through-holes 20 can be chamfered for flushly receiving hex head bolt 19. It is preferable that the blade foils 18 be easily replaceable, to affect desired results at discharge or to affect easy change-out at the end of their useful life. To insure maximum life span and decrease static buildup, the blade foils 18 are constructed from carbide and metal combinations; the blades 14 preferably have a ceramic or tungsten coating for increasing longevity.

Figure 3C:
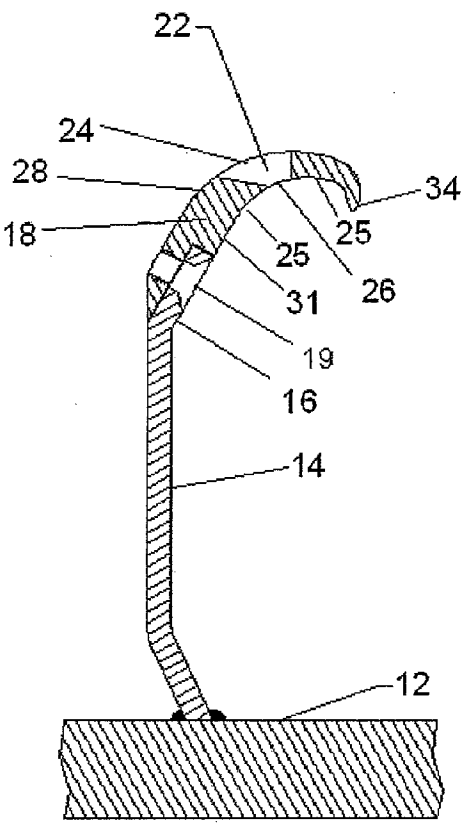
FIG. 3C is a side view of a turbine blade with attached blade foil, this variant of the blade foil being of a relaxed configuration.
Figure 3B:
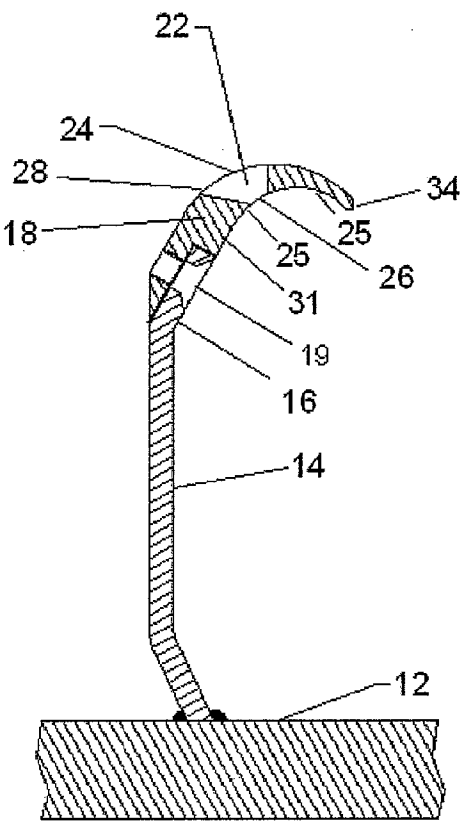
FIG. 3B is a side view of a turbine blade with attached blade foil, this variant of the blade foil being of a medium configuration.
Figure 3A:
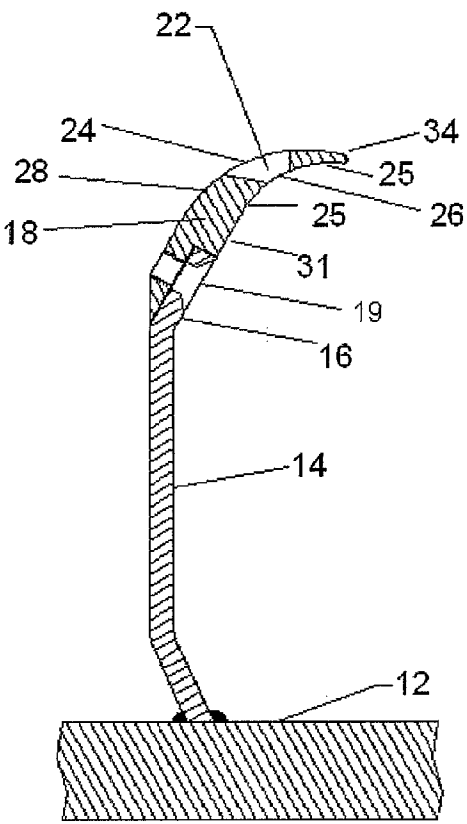
FIG. 3A is a side view of a turbine blade with attached blade foil, this variant of the blade foil being of a tightened configuration.

Referring also to FIGS. 3A, 3B and 3C are examples of three varying configurations of blade foils 18. Blade foils have a concave section 25 on their front surface 31 which faces into the air as the turbine blade spins. The shape of the concave section 25 affects the amount of vacuum flow (negative pressure) occurring within the expansion chamber of a comminuting machine employing the inventive turbine. FIG. 3A illustrates a tightened blade foil configuration where the concave section 25 is more elongated than the other examples shown in FIGS. 3B and 3C. FIG. 3B, represents a medium blade foil configuration where the concave section 25 is more radically curved than that of FIG. 3A, but less so than the configuration of FIG. 3C, which represents a relaxed configuration. The concave section 25 of the FIG. 3A example of blade foil 18 ends in a leading edge 34 which is approximately parallel to backing plate 12. In the FIG. 3B example, the leading edge 34 points in a slightly downward and off-parallel relation to backing plate 12. In FIG. 3C, the leading edge 34 points toward and perpendicularly to the backing plate 12.

The different foil configurations allow a comminuting machine to be configured for specific materials and allow particle size and moisture content of the processed material to be altered to desired parameters. The tightened configuration of FIG. 3A results in producing the maximum vacuum flow (negative pressure), of the three configurations shown, and causes the input material to endure maximum fracturing and therefore the highest discrimination in resulting output particle sizes. The relaxed configuration of FIG. 3C results in the least amount of vacuum flow (negative pressure) and lessened instances of fracturing, but the highest drying of output material (best moisture control). The medium configuration of FIG. 3B represents a compromise between the high level of material discrimination of the FIG. 3A variant, and the high level of moisture reduction of the FIG. 3C variant. Depending on the input material and the desired output, the operator can select between the blade foils 18 described to achieve the desired results.

Figure 4:
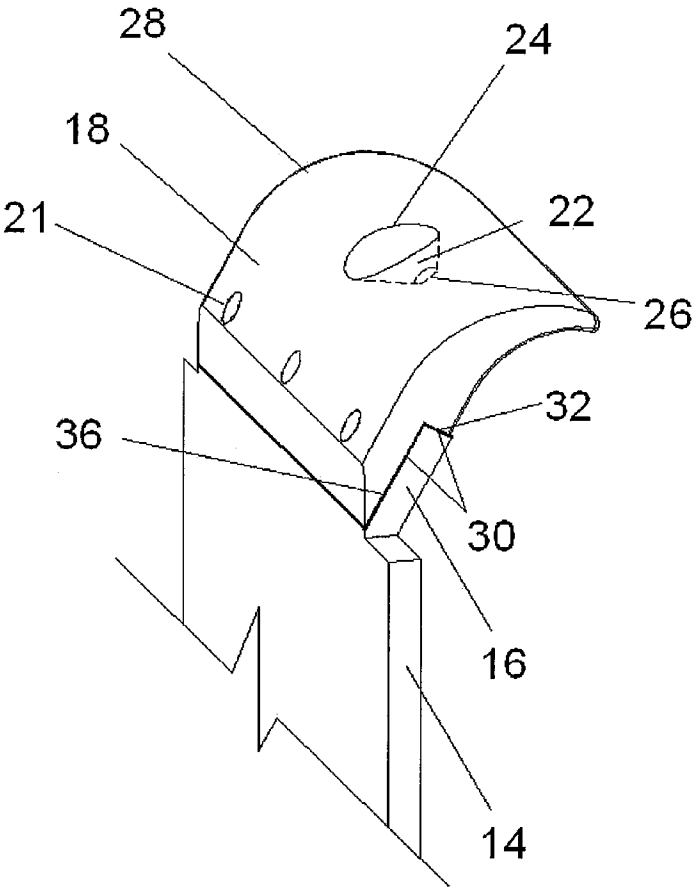
FIG. 4 is a perspective view of a blade foil detached from the turbine blade of the invention.

Referring also to FIG. 4, the back surface 28 of blade foil 18 is preferably curved for good aerodynamic characteristics. Also, blade foils 18 have an overlapping cutout 30 for overlapping the leading edge 16 of turbine blades 14. Upon mating cutout 30 upon leading edge 16, the fit between blade foil 18 and turbine blade 14 is flush at the joining surfaces 32, 36 between leading edge 16 and blade foil 18.

Still referring to the drawings, a vent chamber 22 penetrates each blade foil 18. The vent chamber 22 has an inlet 26 and an outlet 24, the inlet and outlet being circular or oval in shape. As shown here, the inlet 26 is larger in diameter than the outlet 24 which has effects on air volume and gives vent chamber 22 a conical shape. The vent chamber 22 is centered on the blade foil 18 and is positioned so that the inlet 26 opens out to the concave section 25 and provides venting of air captured within concave section 25 during rotation of the turbine 10. The vent chamber 22 functions to increase air volume flowing between the adjacent turbine blades 14 to aid in drying particulate materials. Furthermore, the vent chamber 22 functions to increase air turbulence within the air stream to reduce sound transfer. Rotary turbine comminuting machines are known to create high decibel readings, which is a drawback to their operation in areas with adjacent populations. The sound reduction achieved by the inventive blade foils 18 is variable with the RPM of the turbine 10, but sound reduction of 20% (percent) to 40% (percent) have been achieved when compared to standard comminuting systems. Note that alternatively arranging the vent chamber 22 so that the outlet is smaller than the inlet, air pressure is affected, as the vent chamber functions as a venturi in this configuration. Reversing the sizings of the inlet (large) and outlet (small) increases the material volume and reduces the amount of sound being transmitted from a comminuting machine.

Figure 5:
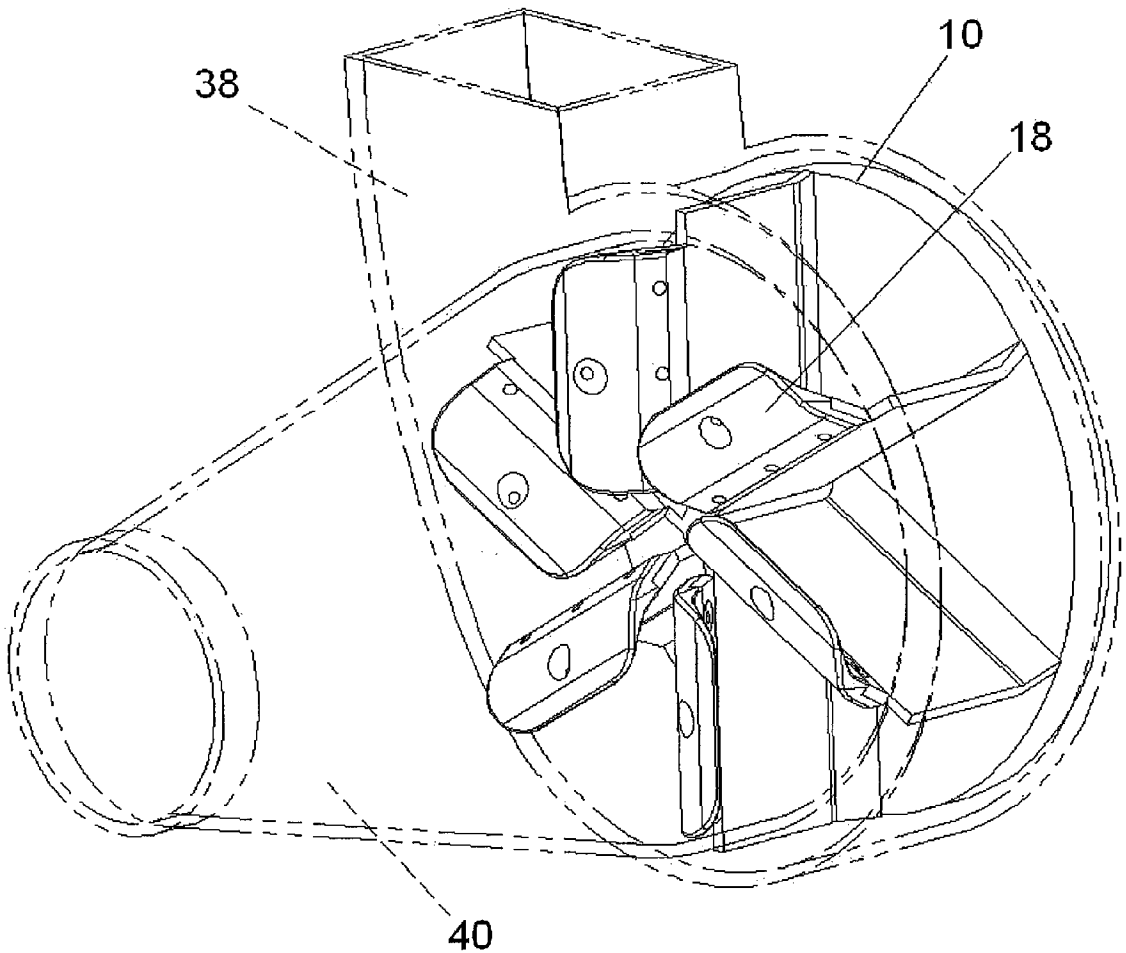
FIG. 5 is a perspective view of the inventive turbine blade mounted in a comminuting machine, which is drawn in phantom.

FIG. 5 shows the inventive turbine as it would appear added to a comminuting machine. The turbine 10 is mounted in a housing 36 next to the expansion chamber 38; it is within the expansion chamber that the inlet material is fractured due to negative air pressure therein. When added to a turbine 10, the inventive blade foils 18 have been found to reduce the moisture level in processed materials by a minimum of 16% (percent). The level of drying achieved by a machine employing the inventive blade foils 18, has achieved several impressive results so far. One result has been the efficient processing of Kaolinite, which can be separated into valuable mud and silica sand components. Presently, the state of the art is to process Kaolinite using a wet process method which is energy and labor intensive. A comminuting machine employing the inventive blade foils 18 can bring processing costs down to as low as 10% of the cost per ton when compared to a wet process method. Kaolinite typically enters a machine employing the invention with 12.5% moisture content (by weight) and leaves the machine as a dry, processed dust.

Another efficient application of the invention is to apply it to ultra-fine coal particulate waste which is a by-product of coal processing. The invention can reduce the particulate to a coal dust, which can be directly used as a clean burning and highly efficient fuel for heating or power generation.

Other applications can be envisioned by the inventors for any particulate material which would benefit from the drying effects provided by the invention. For example, mine tailings, which typically have moisture contents of 15% (percent) or greater, cannot be processed presently, using only an air processing medium, until a significant amount of moisture has been removed by sunlight or expensive mechanical drying means. In contrast, the invention can bring the tailings within an acceptable moisture level for efficient processing.

Another application which is envisioned by the inventors is applying the invention to multiple machines connected in series. This will increase the tonnage passing through the invention without additional handling and/or transport costs associated with the processing of the material. Enhanced size and moisture control at discharge are also achieved.

Finally, although the description above contains much specificity, these should not be construed as limiting the scope of the invention but as merely providing illustrations of some of the presently preferred embodiments of this invention. This invention may be altered and rearranged in numerous ways by one skilled in the art without departing from the coverage of any appended patent claims which are supported by this specification.

The invention claimed is:

1. A turbine for a comminuting machine, the turbine comprising:

a backing plate;

a plurality of turbine blades joined to said backing plate and extending upright from said backing plate, said turbine blades joining together at a central axis;

each of said turbine blades including a leading edge slanted at an angle;

said leading edge of each of said turbine blades further including a plurality of through-holes;

each of said leading edges being joined to a blade foil, said blade foil having a concave front surface and a curved back surface;

each of said blade foils having through-holes for aligning with said through-holes of said leading edges;

said blade foils including an overlapping section for matably overlapping with said leading edges in a flush manner;

fastening means for joining said leading edges to said blade foils, said fastening means insertable into said through-holes of said leading edges and said through-holes of said blade foils; and a conical vent chamber penetrating said blade foil, said vent chamber having an inlet and an outlet wherein said inlet and outlet are of different diameters.

2. The turbine as recited in claim 1, wherein said vent chamber is approximately centered upon said blade foil.

3. The turbine as recited in claim 1, wherein said inlet of said vent chamber opens to said concave front surface of said blade foil and said outlet of said vent chamber opens to said rear surface of said blade foil.

4. The turbine as recited in claim 3, wherein said inlet is smaller in diameter than said outlet.

5. The turbine as recited in claim 3, wherein said inlet is larger in diameter than said outlet.

6. A turbine for a comminuting machine, the turbine comprising:

a backing plate;

a plurality of turbine blades joined to said backing plate and extending upright from said backing plate, said turbine blades joining together at a central axis;

each of said turbine blades including a leading edge;

each of said leading edges being joined to a blade foil, said blade foil having at least a curved front surface; and a vent chamber penetrating said blade foil, said vent chamber having an inlet and an outlet wherein said inlet and outlet are of different diameters.

7. The turbine as recited in claim 6, further comprising detachable joining means for detachably joining said turbine blade to said blade foil.

8. The turbine as recited in claim 6, wherein said vent chamber is approximately centered upon said blade foil.

9. The turbine as recited in claim 6, wherein said inlet of said vent chamber opens to said front surface of said blade foil and said outlet of said vent chamber opens to said rear surface of said blade foil.

10. The turbine as recited in claim 9, wherein said inlet is smaller in diameter than said outlet.

11. The turbine as recited in claim 9, wherein said inlet is larger in diameter than said outlet.

12. The turbine as recited in claim 6, wherein said leading edges of said turbine blades are slanted at an angle.

13. The turbine as recited in claim 6, wherein said blade foils include an overlapping section for mateably overlapping with said leading edges of said turbine blades in a flush manner.

14. The turbine as recited in claim 6, wherein said vent chamber is conically shaped.

15. A comminuting machine comprising a turbine, a turbine housing and an expansion chamber, wherein said turbine further comprises:

a backing plate;

a plurality of turbine blades joined to said backing plate and extending upright from said backing plate, said turbine blades joining together at a central axis;

each of said turbine blades including a leading edge;

each of said leading edges being joined to a blade foil, said blade foil having at least a curved front surface; and a vent chamber penetrating said blade foil, said vent chamber having an inlet and an outlet wherein said inlet and outlet are of different diameters.

16. A comminuting machine comprising a turbine, a turbine housing and an expansion chamber, wherein said turbine further comprises:

a plurality of turbine blades;

at least one blade foil forming a terminus of at least a one of said turbine blades;

said blade foil having at least a curved front surface; and a vent chamber penetrating said blade foil, said vent chamber having an inlet and an outlet.

17. The comminuting machine of claim 16, wherein said inlet and outlet of said vent chamber are of different diameters.

18. The comminuting machine as recited in claim 17, wherein said inlet opens to said front surface of said blade foil and said outlet opens to said rear surface of said blade foil.

19. The comminuting machine as recited in claim 18, wherein said inlet is smaller in diameter than said outlet.

20. The comminuting machine as recited in claim 18, wherein said inlet is larger in diameter than said outlet.

* * * * *